US011401594B2

(12) United States Patent
Kimura et al.

(10) Patent No.: US 11,401,594 B2
(45) Date of Patent: Aug. 2, 2022

(54) HOT-ROLLED STEEL SHEET FOR COILED TUBING AND METHOD FOR MANUFACTURING THE SAME

(71) Applicant: JFE Steel Corporation, Tokyo (JP)

(72) Inventors: Hideyuki Kimura, Tokyo (JP); Shuji Kawamura, Tokyo (JP); Ichiro Sugimoto, Tokyo (JP); Makoto Asai, Tokyo (JP); Takeshi Yokota, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 4 days.

(21) Appl. No.: 16/964,630

(22) PCT Filed: Jan. 16, 2019

(86) PCT No.: PCT/JP2019/000995
§ 371 (c)(1),
(2) Date: Jul. 24, 2020

(87) PCT Pub. No.: WO2019/146458
PCT Pub. Date: Aug. 1, 2019

(65) Prior Publication Data

US 2021/0054487 A1 Feb. 25, 2021

(30) Foreign Application Priority Data

Jan. 29, 2018 (JP) ..... JP2018-012254

(51) Int. Cl.

| | |
|---|---|
| ***C22C 38/54*** | (2006.01) |
| ***C21D 8/02*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/54* (2013.01); *C21D 8/0205* (2013.01); *C21D 8/0226* (2013.01); *C21D 9/08* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search
CPC .. C21D 2211/002; C21D 6/004; C21D 6/005; C21D 6/008; C21D 8/0205; C21D 8/0226; C21D 8/0263; C21D 9/08; C21D 38/00
USPC ..... 420/91
See application file for complete search history.

(56) References Cited

U.S. PATENT DOCUMENTS

| | | | | |
|---|---|---|---|---|
| 9,803,258 | B2 | 10/2017 | Valdez et al. | |
| 2015/0004050 | A1 | 1/2015 | Matsuki et al. | |
| 2017/0333982 | A1 | 11/2017 | Matsuki et al. | |
| 2019/0062862 | A1* | 2/2019 | Nakata | C22C 38/00 |

FOREIGN PATENT DOCUMENTS

| | | | |
|---|---|---|---|
| CN | 102333899 | A | 1/2012 |
| CN | 102953017 | A | 3/2013 |
| CN | 103108972 | A | 5/2013 |
| CN | 103108974 | A | 5/2013 |
| CN | 103649351 | A | 3/2014 |
| CN | 103917682 | A | 7/2014 |
| EP | 1568792 | A1 | 8/2005 |
| EP | 2589673 | A1 | 5/2013 |
| EP | 2617850 | A1 | 7/2013 |
| EP | 2617852 | A1 | 7/2013 |
| EP | 2728029 | A1 | 5/2014 |
| EP | 2759615 | A1 | 7/2014 |
| EP | 3187601 | A1 | 7/2017 |
| JP | 06256845 | A | 9/1994 |
| JP | 4475023 | B2 | 6/2010 |
| JP | 5494895 | B2 | 5/2014 |
| JP | 2014208888 | A | 11/2014 |
| JP | 2016148096 | A | 8/2016 |

(Continued)

OTHER PUBLICATIONS

NPL-1: Pillot et al, Effect of pre-strain on mechanical properties of pressure vessel steel grades-assessment of stress relieving/post weld heat treatments efficiency at regenerating properties, Proceedings of the ASME 2014 pressure vessels & piping conference, July, 20-24, 2014. pp. 1-12 (Year: 2014).*

International Search Report and Written Opinion for International Application No. PCT/JP2019/000995, dated Apr. 16, 2019, 5 pages. 2020.

(Continued)

*Primary Examiner* — Jie Yang

(74) *Attorney, Agent, or Firm* — RatnerPrestia

(57) ABSTRACT

Provided are a hot-rolled steel sheet for coiled tubing and a method for manufacturing the steel sheet. The steel sheet has a yield strength of 480 MPa or more, a tensile strength of 600 MPa or more, a yield-strength difference (ΔYS) of 100 MPa or more, where the yield-strength difference is defined as a difference in yield strength between before and after a prestrain-heat treatment performed for simulation of a tube-making process and a stress-relief annealing heat treatment which are currently implemented, and a yield strength of 620 MPa or more after the prestrain-heat treatment.

4 Claims, No Drawings

(56) References Cited

FOREIGN PATENT DOCUMENTS

| | | | |
|---|---|---|---|
| RU | 2268311 | C2 | 1/2006 |
| RU | 2360013 | C2 | 6/2009 |
| RU | 2518830 | C1 | 6/2014 |
| WO | 03025241 | A1 | 3/2003 |
| WO | 2012133558 | A1 | 10/2012 |
| WO | 2013108861 | A1 | 7/2013 |
| WO | 2017130875 | A1 | 8/2017 |

OTHER PUBLICATIONS

Canadian Office Action for Canadian Application No. 3,085,298, dated Jun. 25, 2021, 4 pages.
Chinese Office Action with Search Report for Chinese Application No. 201980010746.1, dated May 27, 2021, 12 pages.
Extended European Search Report for European Application No. 19 744 117.3, dated Aug. 7, 2020, 7 pages.
Russian Office Action for Russian Application No. 2020124288, dated Dec. 30, 2020 with translation, 20 pages.
Korean Office Action for Korean Application No. 10-2020-7021587, dated Jan. 3, 2022, with Concise Statement of Relevance of Office Action, 6 pages.

* cited by examiner

HOT-ROLLED STEEL SHEET FOR COILED TUBING AND METHOD FOR MANUFACTURING THE SAME

CROSS REFERENCE TO RELATED APPLICATIONS

This is the U.S. National Phase application of PCT/JP2019/000995, filed Jan. 16, 2019, which claims priority to Japanese Patent Application No. 2018-012254 filed Jan. 29, 2018, the disclosures of these applications being incorporated herein by reference in their entireties for all purposes.

FIELD OF THE INVENTION

The present invention relates to a hot-rolled steel sheet for coiled tubing and a method for manufacturing the steel sheet, and in more detail, to a hot-rolled steel sheet for coiled tubing having a yield strength of 480 MPa or more, a tensile strength of 600 MPa or more, a yield-strength difference (ΔYS) of 100 MPa or more, where the yield-strength difference is defined as a difference in yield strength between before and after a prestrain-heat treatment at 650° C. for 60 seconds after 5% pre-straining, and a yield strength of 620 MPa or more after the prestrain-heat treatment.

BACKGROUND OF THE INVENTION

Coiled tubing, which is manufactured by coiling a long electric resistance welded steel tube having an outer diameter of about 20 mm to 100 mm around a reel, is widely used for various kinds of operations in a well such as for removing sand deposited in an oil well and for measuring temperature, humidity, depth, and so forth in an oil well. Recently, cold tubing has begun to be used for drilling a shale gas well or an oil well.

Coiled tubing is manufactured by slitting a hot-rolled steel sheet, which is used as a material, in the longitudinal direction in accordance with the diameter of a tube, by welding the slit steel strips to form a steel strip having a predetermined length, by forming the welded strip into a tube shape by performing roll forming, by performing electric resistance welding on the formed strip, by performing stress-relief annealing on the welded tube to improve the quality of a weld and to prevent sulfide stress corrosion cracking, and by reeling the annealed tube.

In order to prevent a well breakage, the coiled tubing is required to have a high strength in the longitudinal direction after tube manufacturing, for example, a yield strength of 90 ksi (620 MPa) or more.

In response to such a requirement, Patent Literature 1 discloses a steel strip for coiled tubing and a method for manufacturing the steel strip. The method includes performing hot finish rolling under the condition of a finish rolling temperature of 820° C. or higher and 920° C. or lower on steel having a chemical composition containing, by mass %, C: 0.10% or more and 0.16% or less, Si: 0.1% or more and 0.5% or less, Mn: 0.5% or more and 1.5% or less, P: 0.02% or less, S: 0.005% or less, Sol.Al: 0.01% or more and 0.07% or less, Cr: 0.4% or more and 0.8% or less, Cu: 0.1% or more and 0.5% or less, Ni: 0.1% or more and 0.3% or less, Mo: 0.1% or more and 0.2% or less, Nb: 0.01% or more and 0.04% or less, Ti: 0.005% or more and 0.03% or less, N: 0.005% or less and coiling the hot-rolled steel strip at a coiling temperature of 550° C. or higher and 620° C. or lower within 20 seconds after hot finish rolling has been performed.

Patent Literature 2 discloses coiled tubing having a chemical composition containing, by weight %, C: 0.17% to 0.35%, Mn: 0.30% to 2.00%, Si: 0.10% to 0.30%, Al: 0.010% to 0.040%, S: 0.010% or less, P: 0.015% or less, a steel microstructure mainly including tempered martensite, a yield strength of 80 ksi (551 MPa) to 140 ksi (965 MPa), and excellent low-cycle fatigue resistance and a method for manufacturing the coiled tubing.

Patent Literature

PTL 1: Japanese Patent No. 5494895

PTL 2: Japanese Unexamined Patent Application Publication No. 2014-208888

SUMMARY OF THE INVENTION

The technique described in Patent Literature 1 relates to a steel strip for coiled tubing excellent in terms of homogeneity in material properties with a decreased variation in material properties in the longitudinal and width directions of the hot-rolled steel sheet. However, since there is no mention of yield strength after tube making has been performed, it may not be possible to achieve sufficiently high strength for actual coiled tubing.

In addition, in the case of the technique described in Patent Literature 2, since it is necessary to perform a quenching treatment and a tempering treatment on the whole tube after tube making has been performed on a hot-rolled steel sheet to form a microstructure mainly including tempered martensite, it is necessary to introduce a new facility, which may result in an increase in manufacturing costs.

Therefore, in view of the situation described above, an object according to aspects of the present invention is to provide a hot-rolled steel sheet for coiled tubing having a yield strength of 480 MPa or more, a tensile strength of 600 MPa or more, a yield-strength difference (ΔYS) of 100 MPa or more, where the yield-strength difference is defined as a difference in yield strength between before and after a prestrain-heat treatment, in which the steel sheet is subjected to a heat treatment at a temperature of 650° C. for 60 seconds after 5% pre-straining, and a yield strength of 620 MPa or more after the prestrain-heat treatment has been performed and a method for manufacturing the steel sheet.

The present inventors have diligently conducted investigations regarding a method for achieving the desired yield strength after tube making and stress-relief annealing have been performed and, as a result, found that, by forming a chemical composition containing elements such as C, Mn, Cr, Nb, and Ti in appropriately controlled amounts, by controlling the heating temperature of a steel slab and a finish rolling temperature, by performing accelerated cooling to a cooling stop temperature of 600° C. or lower at a cooling rate of 30° C./s or higher, and by performing coiling at a temperature of 450° C. or higher and 600° C. or lower, it is possible to form a microstructure mainly including bainite and bainitic ferrite in which the amount of solid solution Nb is 20% or more of the total Nb content, and it is possible to obtain a hot-rolled steel sheet for coiled tubing having a yield strength of 480 MPa or more, a tensile strength of 600 MPa or more, a yield-strength difference (ΔYS) of 100 MPa or more, where the yield-strength difference is defined as a difference in yield strength between before and after a prestrain-heat treatment, in which the steel sheet is subjected to a heat treatment at a temperature of 650° C. for 60 seconds after 5% pre-straining, and a yield strength of 620 MPa or more after the prestrain-heat treatment. That is, it has been found that, by using the hot-rolled steel sheet described above, it is possible to obtain coiled tubing having the desired yield strength 620 MPa) through strain-aging hardening caused by tube making and stress-relief annealing.

The subject matter according to aspects of the present invention is as follows.

[1] A hot-rolled steel sheet for coiled tubing, the steel sheet having a chemical composition containing, by mass %, C: 0.10% or more and 0.16% or less, Si: 0.1% or more and 0.5% or less, Mn: 0.8% or more and 1.8% or less, P: 0.001% or more and 0.020% or less, S: 0.0050% or less, Al: 0.01% or more and 0.08% or less, Cu: 0.1% or more and 0.5% or less, Ni: 0.1% or more and 0.5% or less, Cr: 0.5% or more and 0.8% or less, Mo: 0.10% or more and 0.5% or less, Nb: 0.01% or more and 0.05% or less, Ti: 0.01% or more and 0.03% or less, N: 0.001% or more and 0.006% or less, and a balance of Fe and inevitable impurities, a microstructure at a position located at ½ of a thickness of the steel sheet including bainite and bainitic ferrite in a total amount of 80% or more in terms of area fraction, in which an amount of solid solution Nb is 20% or more of a total Nb content, a yield strength of 480 MPa or more, a tensile strength of 600 MPa or more, a yield-strength difference (ΔYS) of 100 MPa or more, where the yield-strength difference is defined as a difference in yield strength between before and after a prestrain-heat treatment, in which the steel sheet is subjected to a heat treatment at a temperature of 650° C. for 60 seconds after 5% pre-straining, and a yield strength of 620 MPa or more after the prestrain-heat treatment.

The hot-rolled steel sheet for coiled tubing according to item [1] above, in which the chemical composition further contains, by mass %, one, two, or more selected from B: 0.0005% or more and 0.0050% or less, V: 0.01% or more and 0.10% or less, Ca: 0.0005% or more and 0.0100% or less, REM: 0.0005% or more and 0.0200% or less, Zr: 0.0005% or more and 0.0300% or less, and Mg: 0.0005% or more and 0.0100% or less.

[3] A method for manufacturing the hot-rolled steel sheet for coiled tubing according to item [1] or [2] above, the method including heating a steel slab having the chemical composition to a temperature of 1100° C. or higher and 1250° C. or lower, performing rough rolling on the heated steel slab, performing finish rolling on the rough-rolled steel slab under a condition of a finish rolling temperature of 820° C. or higher and 920° C. or lower, cooling the finish-rolled steel sheet to a temperature of 600° C. or lower at an average cooling rate of 30° C./s or higher and 100° C./s or lower in terms of a temperature in a central portion in a thickness direction of the steel sheet, and coiling the cooled steel sheet at a temperature of 450° C. or higher and 600° C. or lower.

According to aspects of the present invention, by appropriately controlling rolling conditions and cooling conditions after rolling has been performed, it is possible to form a steel microstructure mainly including bainite and bainitic ferrite, in which the amount of solid solution Nb is equal to or more than the predetermined value, and, as a result, it is possible to obtain a hot-rolled steel sheet having a yield strength of 480 MPa or more and a tensile strength of 600 MPa or more and to obtain coiled tubing having the desired yield strength (≥620 MPa) through strain-aging hardening caused by tube making and stress-relief annealing, producing a significant effect on the industry.

DETAILED DESCRIPTION OF EMBODIMENTS OF THE INVENTION

Hereafter, embodiments of the present invention will be described in detail.

First, the reasons for the limitations on the chemical composition according to aspects of the present invention will be described. Here, "%" regarding constituents denotes mass %.

C: 0.10% or More and 0.16% or Less

C is effective for increasing strength through transformation strengthening by forming a microstructure mainly including bainite and bainitic ferrite after accelerated cooling has been performed. However, in the case where the C content is less than 0.10%, since polygonal ferrite transformation and pearlite transformation tend to occur during cooling, it is not possible to form bainite and bainitic ferrite in the predetermined total amount, which may make it impossible to achieve the desired strength of a hot-rolled steel sheet (TS≥600 MPa). On the other hand, in the case where the C content is more than 0.16%, since it is difficult to achieve the amount of solid solution Nb equal to or more than the predetermined amount due to NbC being difficult to dissolve when a steel slab is heated, there is insufficient strain-aging hardening caused by tube making and stress-relief annealing, which may result in coiled tubing having the desired yield strength 620 MPa) not being obtained. Therefore, the C content is set to be 0.10% or more and 0.16% or less. It is preferable that the C content be 0.11% or more. In addition, it is preferable that the C content be 0.13% or less.

Si: 0.1% or More and 0.5% or Less

Si is an element which is necessary for deoxidation and which is effective for increasing the strength of a hot-rolled steel sheet through solid-solution strengthening. To realize such effects, it is necessary that the Si content be 0.1% or more. On the other hand, in the case where the Si content is more than 0.5%, there is a deterioration in the quality of a weld. In addition, red scale is markedly generated, which results in a deterioration in the surface appearance quality of a steel sheet. Therefore, the Si content is set to be 0.1% or more and 0.5% or less. It is preferable that the Si content be 0.1% or more and 0.3% or less.

Mn: 0.8% or More and 1.8% or Less

Mn is, like C, effective for increasing strength through transformation strengthening by forming a microstructure mainly including bainite and bainitic ferrite after accelerated cooling has been performed. However, in the case where the Mn content is less than 0.8%, since polygonal ferrite transformation and pearlite transformation tend to occur during cooling, it is not possible to form bainite and bainitic ferrite in the predetermined total amount, which may make it impossible to achieve the desired strength of a hot-rolled steel sheet (TS 600 MPa). On the other hand, in the case where the Mn content is more than 1.8%, the effect of increasing strength becomes saturated, and there is a deterioration in weldability. In addition, since Mn is concentrated in a segregation portion, which is inevitably formed when casting is performed, there may be a deterioration in the fatigue resistance of coiled tubing. Therefore, the Mn content is set to be 0.8% or more and 1.8% or less. It is preferable that the Mn content be 0.8% or more and 1.6% or less or more preferably 0.8% or more and 1.2% or less.

P: 0.001% or More and 0.020% or Less

P is an element which is effective for increasing the strength of a hot-rolled steel sheet through solid-solution strengthening. However, in the case where the P content is less than 0.001%, such an effect is not realized, and there may be an increase in dephosphorization costs in a steel-making process. Therefore, the P content is set to be 0.001% or more. On the other hand, in the case where the P content is more than 0.020%, there is a marked deterioration in weldability. In addition, since there is an increase in the inhomogeneity of material properties due to P being segregated at grain boundaries, there may be a deterioration in the low-cycle fatigue resistance of coiled tubing. Therefore, the P content is set to be 0.001% or more and 0.020% or less. It is preferable that the P content be 0.001% or more and 0.010% or less.

S: 0.0050% or Less

S causes hot brittleness and may cause a deterioration in ductility and toughness as a result of existing in the form of sulfide-based inclusions in steel. In addition, since S may be the initiation site of fatigue cracking, there may be a deterioration in the fatigue resistance of coiled tubing. Therefore, it is preferable that the S content be as small as possible, and, in accordance with aspects of the present invention, the upper limit of the S content is set to be 0.0050%. It is preferable that the S content be 0.0015% or less. Although there is no particular limitation on the lower limit of the S content, there is an increase in steel-making costs in the case where an attempt is made to achieve ultralow S content. Therefore, it is preferable that the S content be 0.0001% or more.

Al: 0.01% or More and 0.08% or Less

Al is an element which is added as a deoxidizing agent. In addition, since Al has a solid-solution strengthening capability, Al is effective for increasing the strength of a hot-rolled steel sheet. However, in the case where the Al content is less than 0.01%, there may be a case where it is not possible to realize such effects. On the other hand, in the case where the Al content is more than 0.08%, there is an increase in raw material costs, and there may be a deterioration in toughness. Therefore, the Al content is set to be 0.01% or more and 0.08% or less. It is preferable that the Al content be 0.01% or more and 0.05% or less.

Cu: 0.1% or More and 0.5% or Less

Cu is an element which is added to provide corrosion resistance. In addition, since Cu, which is an element having hardenability, forms a microstructure mainly including bainite and bainitic ferrite after accelerated cooling has been performed, Cu is effective for increasing strength through transformation strengthening. To realize such effects, it is necessary that the Cu content be 0.1% or more. On the other hand, in the case where the Cu content is more than 0.5%, the effect of increasing strength becomes saturated, and there is a deterioration in weldability. Therefore, the Cu content is set to be 0.1% or more and 0.5% or less. It is preferable that the Cu content be 0.2% or more. In addition, it is preferable that the Cu content be 0.4% or less.

Ni: 0.1% or More and 0.5% or Less

Ni is, like Cu, an element which is added to provide corrosion resistance. In addition, since Ni, which is an element having hardenability, forms a microstructure mainly including bainite and bainitic ferrite after accelerated cooling has been performed, Ni is effective for increasing strength through transformation strengthening. To realize such effects, it is necessary that the Ni content be 0.1% or more. On the other hand, Ni is very expensive, and such effects become saturated in the case where the Ni content is more than 0.5%. Therefore, the Ni content is set to be 0.1% or more and 0.5% or less. It is preferable that the Ni content be 0.1% or more and 0.3% or less.

Cr: 0.5% or More and 0.8% or Less

Cr is, like Cu and Ni, an element which is added to provide corrosion resistance. In addition, since Cr, which is an element having hardenability, forms a microstructure mainly including bainite and bainitic ferrite after accelerated cooling has been performed, Cr is effective for increasing strength through transformation strengthening. Moreover, since Cr increases temper softening resistance, Cr is effective for increasing the strength of coiled tubing by inhibiting softening when stress-relief annealing is performed after tube making has been performed. To realize such effects, it is necessary that the Cr content be 0.5% or more. On the other hand, in the case where the Cr content is more than 0.8%, the effect of increasing strength becomes saturated, and there is a deterioration in weldability. Therefore, the Cr content is set to be 0.5% or more and 0.8% or less. It is preferable that the Cr content be 0.5% or more and 0.7% or less.

Mo: 0.10% or More and 0.5% or Less

Mo, which is an element having hardenability, is effective for increasing the strength through transformation strengthening by forming a microstructure mainly including bainite and bainitic ferrite after accelerated cooling has been performed. In addition, since Mo increases temper softening resistance, Mo is effective for increasing the strength of coiled tubing by inhibiting softening when stress-relief annealing is performed after tube making has been performed. To realize such effects, it is necessary that the Mo content be 0.10% or more. On the other hand, in the case where the Mo content is more than 0.5%, the effect of increasing strength becomes saturated, and there is a deterioration in weldability. Therefore, the Mo content is set to be 0.10% or more and 0.5% or less. It is preferable that the Mo content be 0.50% or less, more preferably 0.3% or less, or even more preferably 0.30% or less.

Nb: 0.01% or More and 0.05% or Less

By allowing Nb to exist in the form of solid solution Nb in the predetermined amount at the hot-rolled steel sheet stage, Nb contributes to increasing the strength of coiled tubing through strain-aging hardening when tube making and stress-relief annealing are performed afterward. In addition, Nb increases the strength of a hot-rolled steel sheet without causing a deterioration in weldability as a result of being finely precipitated in the form of carbonitrides. To realize such effects, the Nb content is set to be 0.01% or more. On the other hand, in the case where the Nb content is more than 0.05%, since it is difficult to contain the amount of solid solution Nb equal to or more than the predetermined amount due to NbC being difficult to dissolve when a steel slab is heated, there is insufficient strain-aging hardening caused by tube making and stress-relief annealing, which may result in coiled tubing having the desired yield strength 620 MPa) not being obtained. Therefore, the Nb content is set to be 0.01% or more and 0.05% or less. It is preferable that the Nb content be 0.01% or more and 0.03% or less.

Ti: 0.01% or More and 0.03% or Less

Ti is an element which is effective for increasing the strength of a hot-rolled steel sheet through precipitation strengthening. To realize such an effect, it is necessary that the Ti content be 0.01% or more. On the other hand, in the case where the Ti content is more than 0.03%, since there is a coarsening of TiN, TiN may be the initiation site of fatigue cracking, which may result in a deterioration in the fatigue resistance of coiled tubing. Therefore, the Ti content is set to be 0.01% or more and 0.03% or less.

N: 0.001% or More and 0.006% or Less

Since N exists as an impurity and, in particular, causes a deterioration in the toughness of a weld, it is preferable that the N content be as small as possible. However, it is acceptable that the N content be 0.006% or less. On the other hand, in the case where an attempt is made to decrease the N content excessively, there is an increase in the refining costs. Therefore, the N content is set to be 0.001% or more and 0.006% or less. It is preferable that the N content be 0.001% or more and 0.004% or less.

The remainder which is different from the constituents described above is Fe and inevitable impurities.

In addition, in accordance with aspects of the present invention, the chemical composition described above may further contain one, two, or more selected from B, V, Ca, REM, Zr, and Mg in amounts within the ranges described below.

One, two, or more selected from B: 0.0005% or more and 0.0050% or less, V: 0.01% or more and 0.10% or less, Ca: 0.0005% or more and 0.0100% or less, REM: 0.0005% or more and 0.0200% or less, Zr: 0.0005% or more and 0.0300% or less, and Mg: 0.0005% or more and 0.0100% or less B: 0.0005% or More and 0.0050% or Less B contributes to preventing a decrease in strength by inhibiting ferrite transformation as a result of being segregated at austenite grain boundaries. To realize such an effect, it is necessary that the B content be 0.0005% or more. On the other hand, in the case where the B content is more than 0.0050%, such an effect becomes saturated. Therefore, in the case where B is added, the B content is set to be 0.0005% or more and 0.0050% or less.

V: 0.01% or More and 0.10% or Less

V is, like Nb, an element which is effective for increasing the strength of a hot-rolled steel sheet without causing a deterioration in weldability as a result of being finely precipitated in the form of carbonitrides. To realize such an effect, it is necessary that the V content be 0.01% or more. On the other hand, in the case where the V content is more than 0.10%, the effect of increasing strength becomes saturated, and there may be a deterioration in weldability. Therefore, in the case where V is added, the V content is set to be 0.01% or more and 0.10% or less.

Ca, REM, Zr, and Mg have a function of improving ductility and toughness by fixing S in steel, and such an effect is realized in the case where the content of each of the elements is 0.0005% or more. On the other hand, in the case where the contents of Ca, REM, Zr, and Mg are respectively more than 0.0100%, 0.0200%, 0.0300%, and 0.0100%, since there is an increase in the amounts of inclusions in steel, there may be a deterioration in ductility and toughness. Therefore, in the case where these elements are added, the contents of Ca, REM, Zr, and Mg are set to be as follows: Ca: 0.0005% or more and 0.0100% or less, REM: 0.0005% or more and 0.0200% or less, Zr: 0.0005% or more and 0.0300% or less, and Mg: 0.0005% or more and 0.0100% or less.

Hereafter, the microstructure of the hot-rolled steel sheet for coiled tubing according to aspects of the present invention will be described.

The hot-rolled steel sheet for coiled tubing according to aspects of the present invention has a microstructure mainly including bainite and bainitic ferrite, in which the amount of solid solution Nb is 20% or more of the total Nb content, to stably achieve a yield strength of 480 MPa or more, a tensile strength of 600 MPa or more, and a yield-strength difference (ΔYS) of 100 MPa or more, where the yield-strength difference is defined as a difference in yield strength between before and after a prestrain-heat treatment, in which the steel sheet is subjected to a heat treatment at a temperature of 650° C. for 60 seconds after 5% pre-straining. Here, bainitic ferrite is a phase having lower structures having a high dislocation density, and the meaning of the term "bainitic ferrite" includes needle-shaped ferrite and acicular ferrite. In addition, in accordance with aspects of the present invention, the expression "mainly including bainite and bainitic ferrite" denotes a case where the total area fraction of bainite and bainitic ferrite in a microstructure is 80% or more. The remainder of the microstructure which is different from bainite and bainitic ferrite described above may include polygonal ferrite, pearlite, martensite, and so forth, and it is possible to realize the effects according to aspects of the present invention as long as the total area fraction of the remainder of the microstructure is 20% or less.

Total area fraction of bainite and bainitic ferrite at position located at ½ of thickness: 80% or more A bainite phase and a bainitic ferrite phase, which are hard phases, are effective for increasing the strength of a steel sheet through transformation strengthening, and it is possible to achieve the desired strength (TS≥600 MPa) of a hot-rolled steel sheet by controlling the total area fraction of these phases to be 80% or more. On the other hand, in the case where the total area fraction of these phases is less than 80%, since the total area fraction of the remainder of the microstructure including ferrite, pearlite, martensite, and so forth is more than 20%, that is, a multi-phase structure is formed, an interface between different phases may be the initiation site of fatigue cracking, which may result in a deterioration in the fatigue resistance of coiled tubing after tube making has been performed. Therefore, the total area fraction of bainite and bainitic ferrite at a position located at ½ of the thickness ((½)t-position, where "t" denotes the thickness) is set to be 80% or more.

Amount of Solid Solution Nb at Position Located at ½ of Thickness: 20% or More of Total Nb Mass Content In accordance with aspects of the present invention, by allowing solid solution Nb to be exist in the predetermined amount in a hot-rolled steel sheet, it is possible to obtain coiled tubing having the desired strength (yield strength 620 MPa) through strain-aging hardening caused by tube making and stress-relief annealing, which are performed afterward. However, in the case where the amount of solid solution Nb at a position located at ½ of the thickness of the hot-rolled steel sheet is less than 20% of the total Nb mass content, since it is not possible to realize sufficient strain-aging hardening (ΔYS 100 MPa), it may not be possible to obtain coiled tubing having the desired strength (yield strength 620 MPa). Therefore, the amount of solid solution Nb at a position located at ½ of the thickness of the hot-rolled steel sheet is set to be 20% or more of the total Nb mass content. It is preferable that the amount of solid solution Nb at a position located at ½ of the thickness of the hot-rolled steel sheet be 30% or more of the total Nb mass content.

The area fraction of each of the phases in the microstructure described above was determined by performing mirror polishing on an L-section (vertical section parallel to the rolling direction) at a position located at ½ of the thickness, by performing nital etching on the polished section, by observing 5 randomly chosen fields of view by using a scanning electron microscope (SEM) at a magnification of 2000 times to obtain photographs, by identifying the phase in the microstructure photographs, and by performing image analysis.

In addition, the amount of solid solution Nb was determined by taking a test piece for electrolytic extraction from a position located at ½ of the thickness, by performing constant-current electrolysis (about 20 mA/cm$^2$) on the taken test piece in an electrolytic solution (10 vol % acetylacetone-1 mass % tetramethylammonium chloride-methanol), and by determining the amount of the solid solution element dissolved in the electrolytic solution by using an ICP mass spectrometer (refer to the reference below for details).

(Reference) Quantitative Analysis for Solid Solution Content of the Microalloy Elements in Steel, Tetsu-to-Hagané, vol. 99 (2013), No. 5

The hot-rolled steel sheet for coiled tubing according to aspects of the present invention has the following properties.

(1) Hot-rolled steel sheet for coiled tubing having yield strength: 480 MPa or more and tensile strength: 600 MPa or more Coiled tubing is manufactured by slitting a hot-rolled steel sheet, which is used as a material, by forming the slit steel sheet into a tube shape by performing roll forming, by performing electric resistance welding on the formed steel sheet, by performing stress-relief annealing on the welded tube, and by reeling the annealed tube.

To achieve the desired yield strength after tube making and stress-relief annealing have been performed, the properties of the hot-rolled steel sheet, which is used as a material, are important. According to aspects of the present invention, since it is possible to obtain a hot-rolled steel sheet having a yield strength of 480 MPa or more and a tensile strength of 600 MPa or more, it is possible to meet a demand for increasing strength.

(2) Difference (ΔYS) in yield strength between before and after a prestrain-heat treatment, in which the steel sheet is subjected to a heat treatment at a temperature of 650° C. for 60 seconds after 5% pre-straining: 100 MPa or more To meet a demand for increasing the strength of coiled tubing, it is advantageous to increase the difference (ΔYS) in yield strength between before and after a prestrain-heat treatment, in which the steel sheet is subjected to a heat treatment at a temperature of 650° C. for 60 seconds after having been subjected to a prestrain of 5% for simulation of a tube-making process and a stress-relief annealing heat treatment which are currently implemented. By using the hot-rolled steel sheet according to aspects of the present invention, since it is possible to increase the difference ΔYS to 100 MPa or more, preferably 120 MPa or more, or more preferably 140 MPa or more, it is possible to meet a demand for increasing the strength of coiled tubing.

(3) Yield strength after prestrain-heat treatment has been performed: 620 MPa or more Coiled tubing is required to have high strength in the longitudinal direction after tube making has been performed from the viewpoint of preventing fracturing in a well. By using the hot-rolled steel sheet according to aspects of the present invention, since it is possible to achieve a yield strength of 90 ksi (620 MPa) or more after tube making and stress-relief annealing have been performed, it is possible to meet a demand for increasing the strength of coiled tubing.

Hereafter, the method for manufacturing the hot-rolled steel sheet for coiled tubing according to aspects of the present invention will be described.

The hot-rolled steel sheet for coiled tubing according to aspects of the present invention is manufactured by performing a process (heating process) of heating steel having the chemical composition described above to the predetermined temperature, a process (rolling process) of performing hot rolling consisting of rough rolling and finish rolling with the predetermined finish rolling temperature to form a hot-rolled steel sheet, a process (accelerated cooling process) of performing accelerated cooling on the hot-rolled steel sheet at the predetermined cooling rate, and a process (coiling process) of coiling the cooled steel sheet at the predetermined coiling temperature.

Here, in accordance with aspects of the present invention, temperatures such as the heating temperature of a steel slab, the finish rolling temperature, the accelerated cooling stop temperature, and the coiling temperature are defined in terms of the surface temperatures of the steel slab, the hot-rolled steel sheet, and so forth, unless otherwise noted, and it is possible to determine such temperatures by using, for example, a radiation thermometer. In addition, the temperature of a central portion in the thickness direction is defined as the temperature of a central portion in the thickness direction which is calculated from the surface temperatures of the steel slab, hot-rolled steel sheet, and so forth in consideration of parameters such as the thickness and the thermal conductivity. In addition, the average cooling rate is calculated by using the formula ((cooling start temperature)−(cooling stop temperature))/(cooling time from cooling start temperature to cooling stop temperature), unless otherwise noted.

(Manufacturing Steel)

The steel slab according to aspects of the present invention may be manufactured by preparing molten steel having the chemical composition described above by using a known method which utilizes, for example, a converter, an electric furnace, or a vacuum melting furnace, and by using a continuous casting method or an ingot casting-slabbing method, and it is desirable that the steel slab be manufactured by using a continuous casting method to prevent the macro-segregation of the constituents. In addition, not only an existing method, in which, after having manufactured a steel slab, the slab is first cooled to room temperature and then reheated, but also an energy-saving process such as a hot direct rolling, in which a slab in the hot state is charged into a heating furnace without being cooled and then subjected to hot rolling, hot direct rolling or direct rolling, in which a slab is hot-rolled immediately after heat retention has been performed for a short time, or a method (hot-slab charging) in which a slab still having a high temperature is charged into a heating furnace to omit part of reheating may be used without causing any problem.

Steel slab heating temperature: 1100° C. or higher and 1250° C. or lower

In the case where the heating temperature is lower than 1100° C., since there is an increase in resistance to deformation, there is a decrease in rolling efficiency due to an increase in rolling load. In addition, in the case where the heating temperature is lower than 1100° C., since the re-dissolution of NbC and Nb(CN) having a large grain diameter is difficult, it is not possible to achieve the predetermined amount of solid solution Nb after hot rolling has been performed, which may result in sufficient strain-aging hardening (ΔYS≥100 MPa) not being realized. In this case, it may not be possible to obtain coiled tubing having the desired strength (yield strength≥620 MPa). On the other hand, in the case where the heating temperature is higher than 1250° C., since there is a coarsening of austenite in the early stage, there may be a deterioration in the toughness of the hot-rolled steel sheet. Therefore, the steel slab heating temperature is set to be 1100° C. or higher and 1250° C. or lower. It is preferable that the steel slab heating temperature be 1150° C. or higher and 1250° C. or lower.

(Hot Rolling)

Hot rolling including rough rolling and finish rolling is performed on the steel slab obtained as described above. First, the steel slab is made into a sheet bar by performing rough rolling. Here, it is not necessary to put particular limitations on the conditions applied for rough rolling, and commonly applied conditions may be applied. In addition, from the viewpoint of preventing troubles due to a decrease in surface temperature when hot rolling is performed, utilizing a sheet bar heater, with which the sheet bar is heated, is an effective method.

Finish Rolling temperature: 820° C. or higher and 920° C. or lower

In the case where the finish rolling temperature is lower than 820° C., since the temperature of the steel sheet tends to be equal to or lower than the $Ar_3$ temperature, particularly in the edge portion of the steel sheet, it may not be possible to achieve the desired strength due to the formation of soft ferrite. In addition, in the case where rolling is performed after ferrite has been formed, since residual stress is generated, there may be a deterioration in shape after slitting has been performed. On the other hand, in the case where the rolling finish temperature is higher than 920° C., since there is an increase in the amount of oxides (scale) generated, an interface between the base steel and the oxides tends to be roughened, which may result in a deterioration in surface quality. Therefore, the finish rolling temperature is set to be 820° C. or higher and 920° C. or lower. It is preferable that the finish rolling temperature be 820° C. or higher and 880° C. or lower.

Cooling rate in accelerated cooling: average cooling rate of 30° C./s or higher and 100° C./s or lower in terms of temperature in central portion in thickness direction Cooling is started immediately, preferably within 3 seconds, after finish rolling has been performed, and accelerated cooling is performed to a cooling stop temperature of 600° C. or lower at an average cooling rate of 30° C./s or higher and 100° C./s or lower in terms of a temperature in the central portion in the thickness direction. In the case where the average cooling rate is lower than 30° C./s, since polygonal ferrite may be formed during cooling, it is difficult to form a microstructure mainly including bainite and bainitic ferrite, which may result in the desired strength (TS≥600 MPa) of a hot-rolled steel sheet not being achieved. In addition, since NbC tends to be precipitated during cooling, it is not possible to achieve the predetermined amount of solid solution Nb after hot rolling has been performed, which may result in sufficient strain-aging hardening (ΔYS≥100 MPa) not being realized. In this case, it may not be possible to obtain coiled tubing having the desired strength (yield strength≥620 MPa). On the other hand, in the case where the average cooling rate is higher than 100° C./s, the effects described above, that is, the effect of inhibiting the formation of polygonal ferrite and the effect of inhibiting the precipitation of NbC, become saturated. Therefore, the average cooling rate is set to be 30° C./s or higher and 100° C./s or lower. It is preferable that the average cooling rate be 50° C./s or higher and 100° C./s or lower. In addition, in the case where the cooling stop temperature is higher than 600° C., since polygonal ferrite is formed and NbC is precipitated during cooling afterward, it may not be possible to form a microstructure mainly including bainite and bainitic ferrite, and it may not be possible to achieve the predetermined amount of solid solution Nb. Therefore, the cooling stop temperature is set to be 600° C. or lower. Here, the term "cooling rate" denotes an average cooling rate which is calculated by dividing the difference between the cooling start temperature and the cooling stop temperature by the time required for cooling.

Coiling temperature: 450° C. or higher and 600° C. or lower

In a process of coiling and cooling the rolled steel sheet after accelerated cooling has been performed, in the case where the coiling temperature is lower than 450° C., since martensite transformation occurs, that is, a multi-phase structure is formed, an interface between different phases may be the initiation site of fatigue cracking, which may result in a deterioration in the fatigue resistance of coiled tubing after tube making has been performed. On the other hand, in the case where the coiling temperature is higher than 600° C., since an excessive amount of NbC is formed, it is not possible to achieve the predetermined amount of solid solution Nb, which may result in sufficient strain-aging hardening (ΔYS≥100 MPa) not being realized. In this case, it may not be possible to obtain coiled tubing having the desired strength (yield strength≥620 MPa). In addition, since coarse NbC is formed, it may not be possible to achieve the desired strength (TS≥600 MPa) of a hot-rolled steel sheet. Therefore, the coiling temperature is set to be 450° C. or higher and 600° C. or lower. It is preferable that the coiling temperature be 450° C. or higher and less than 550° C. or more preferably 450° C. or higher and 540° C. or lower.

In addition, although the coiled steel sheet is usually cooled with air, by performing cooling at a cooling rate of 15° C./h or higher in terms of average temperature of the edge portion in the width direction of the coil taken from the inner periphery to the outer periphery of the coil, since it is possible to achieve a sufficient amount of solid solution Nb by inhibiting the precipitation of NbC, it is possible to realize strain-aging hardening (ΔYS≥100 MPa) more stably.

The hot-rolled steel sheet (coil) manufactured as described above is subjected to pickling to remove surface scale, slit into a predetermined width, and made into coiled tubing. Here, skin pass rolling (before-pickling skin pass rolling) may be performed before pickling is performed to facilitate the removal of scale, and skin pass rolling may be performed after pickling has been performed to cut off a defective portion and to perform surface inspection.

EXAMPLES

Hereafter, the examples of the present invention will be described.

Example 1

By preparing molten steels having the chemical compositions given in Table 1 by using a converter, by casting the molten steels into steel slabs (steel) by using a continuous casting method, by performing a heating process, a rolling process, an accelerated cooling process, and a coiling process in this order on the steel slabs under the conditions given in Table 2, hot-rolled steel sheets having a thickness of 4.5 mm were manufactured.

TABLE 1

| Steel Code | Chemical Composition (mass %) C | Si | Mn | P | S | Al | Cu | Ni | Cr | Mo | Nb | Ti | N | V | B | Other | Solid-Solution Temperature of Nb*[1] T (° C.) | Note |
|---|---|---|---|---|---|---|---|---|---|---|---|---|---|---|---|---|---|---|
| A | 0.08 | 0.4 | 0.8 | 0.008 | 0.0010 | 0.03 | 0.1 | 0.1 | 0.5 | 0.10 | 0.03 | 0.02 | 0.005 | — | — | — | 1121 | Comparative Steel |
| B | 0.10 | 0.4 | 0.8 | 0.008 | 0.0012 | 0.03 | 0.5 | 0.2 | 0.7 | 0.30 | 0.03 | 0.02 | 0.004 | — | — | REM: 0.0040<br>Mg: 0.0080 | 1147 | Example Steel |
| C | 0.10 | 0.3 | 0.9 | 0.006 | 0.0009 | 0.03 | 0.3 | 0.2 | 0.5 | 0.30 | 0.03 | 0.01 | 0.004 | 0.05 | — | REM: 0.0100<br>Ca: 0.0015 | 1147 | Example Steel |
| D | 0.11 | 0.3 | 0.9 | 0.007 | 0.0009 | 0.03 | 0.3 | 0.3 | 0.6 | 0.20 | 0.03 | 0.02 | 0.003 | — | 0.0005 | — | 1158 | Example Steel |
| E | 0.11 | 0.3 | 0.9 | 0.005 | 0.0010 | 0.03 | 0.3 | 0.2 | 0.6 | 0.30 | 0.03 | 0.02 | 0.003 | — | 0.0010 | — | 1158 | Example Steel |
| F | 0.12 | 0.3 | 1.0 | 0.008 | 0.0012 | 0.04 | 0.2 | 0.1 | 0.6 | 0.10 | 0.03 | 0.02 | 0.003 | 0.05 | 0.0020 | — | 1169 | Example Steel |
| G | 0.13 | 0.3 | 0.9 | 0.007 | 0.0014 | 0.05 | 0.3 | 0.2 | 0.5 | 0.30 | 0.02 | 0.02 | 0.003 | — | — | Zr: 0.0020<br>Ca: 0.0080 | 1127 | Example Steel |
| H | 0.10 | 0.3 | 1.0 | 0.005 | 0.0010 | 0.05 | 0.3 | 0.2 | 0.5 | 0.30 | 0.04 | 0.03 | 0.005 | — | — | Mg: 0.0020<br>Zr: 0.0150 | 1186 | Example Steel |
| I | 0.13 | 0.3 | 0.9 | 0.008 | 0.0009 | 0.03 | 0.3 | 0.2 | 0.6 | 0.20 | 0.02 | 0.02 | 0.004 | — | — | — | 1128 | Example Steel |
| J | 0.11 | 0.2 | 1.2 | 0.005 | 0.0009 | 0.03 | 0.3 | 0.2 | 0.5 | 0.10 | 0.03 | 0.02 | 0.004 | 0.05 | — | — | 1159 | Example Steel |
| K | 0.11 | 0.2 | 1.4 | 0.005 | 0.0009 | 0.03 | 0.3 | 0.2 | 0.5 | 0.10 | 0.03 | 0.02 | 0.004 | 0.05 | — | — | 1159 | Example Steel |
| L | 0.11 | 0.2 | 1.6 | 0.005 | 0.0009 | 0.03 | 0.2 | 0.2 | 0.5 | 0.10 | 0.03 | 0.02 | 0.004 | 0.05 | — | — | 1159 | Example Steel |
| M | 0.10 | 0.2 | 1.2 | 0.006 | 0.0008 | 0.03 | 0.2 | 0.3 | 0.6 | 0.15 | 0.08 | 0.02 | 0.004 | — | 0.0010 | — | 1286 | Comparative Steel |
| N | 0.19 | 0.2 | 0.8 | 0.005 | 0.0012 | 0.05 | 0.1 | 0.1 | 0.5 | 0.10 | 0.04 | 0.02 | 0.006 | — | — | — | 1277 | Comparative Steel |
| O | 0.12 | 0.3 | 0.6 | 0.005 | 0.0009 | 0.03 | 0.3 | 0.2 | 0.5 | 0.10 | 0.02 | 0.02 | 0.003 | — | — | — | 1117 | Comparative Steel |
| P | 0.11 | 0.3 | 0.9 | 0.005 | 0.0009 | 0.03 | 0.3 | 0.2 | 0.3 | 0.10 | 0.02 | 0.02 | 0.003 | — | — | — | 1107 | Comparative Steel |
| Q | 0.10 | 0.3 | 0.9 | 0.005 | 0.0009 | 0.03 | 0.1 | 0.1 | 0.5 | 0.05 | 0.02 | 0.02 | 0.003 | — | — | — | 1095 | Comparative Steel |
| R | 0.11 | 0.3 | 0.8 | 0.005 | 0.0014 | 0.03 | 0.2 | 0.2 | 0.6 | 0.20 | 0.02 | 0.003 | 0.003 | — | — | — | 1107 | Comparative Steel |
| S | 0.12 | 0.3 | 1.0 | 0.007 | 0.0009 | 0.05 | 0.2 | 0.2 | 0.5 | 0.15 | 0.002 | 0.02 | 0.005 | — | — | — | 881 | Comparative Steel |

*[1]T (° C.) = −6770/(logNb + log(C + (12/14)N) − 2.26) − 273, where each of Nb, C, and N in the equation denotes the content (mass %) of the corresponding element.
The remainder which is different from the constituents described above is Fe and inevitable impurities.
Underlined portions indicate items out of the range of the present invention.

TABLE 2

| Steel Sheet No. | Steel Code | Solid-Solution Temperature of Nb*[1] T (° C.) | Heating Process: Temperature (° C.) | Heating Process: Slab Thickness (mm) | Rolling Process: Finish Rolling Temperature (° C.) | Rolling Process: Thickness (mm) |
|---|---|---|---|---|---|---|
| 1 | A | 1121 | 1230 | 220 | 850 | 4.5 |
| 2 | B | 1147 | 1230 | 220 | 850 | 4.5 |
| 3 | C | 1147 | 1230 | 220 | 850 | 4.5 |
| 4 | D | 1158 | 1230 | 220 | 850 | 4.5 |
| 5 | E | 1158 | 1230 | 220 | 850 | 4.5 |
| 6 | F | 1169 | 1230 | 220 | 850 | 4.5 |
| 7 | G | 1127 | 1230 | 220 | 850 | 4.5 |
| 8 | H | 1186 | 1230 | 220 | 850 | 4.5 |
| 9 | I | 1128 | 1230 | 220 | 850 | 4.5 |
| 10 | J | 1159 | 1230 | 220 | 850 | 4.5 |
| 11 | K | 1159 | 1230 | 220 | 850 | 4.5 |
| 12 | L | 1159 | 1230 | 220 | 850 | 4.5 |
| 13 | M | 1286 | 1230 | 220 | 850 | 4.5 |
| 14 | N | 1277 | 1230 | 220 | 850 | 4.5 |
| 15 | O | 1117 | 1230 | 220 | 850 | 4.5 |
| 16 | P | 1107 | 1230 | 220 | 850 | 4.5 |
| 17 | Q | 1095 | 1230 | 220 | 850 | 4.5 |

TABLE 2-continued

| | | | | | | |
|---|---|---|---|---|---|---|
| 18 | R | 1107 | 1230 | 220 | 850 | 4.5 |
| 19 | S | 881 | 1230 | 220 | 850 | 4.5 |

| | Accelerated Cooling Process | | | Coiling Process | | |
|---|---|---|---|---|---|---|
| Steel Sheet No. | Cooling Start Time*2 (s) | Cooling Rate*3 (° C./s) | Cooling Stop Temperature (° C.) | Coiling Temperature (° C.) | Cooling Rate*4 (° C./h) | Note |
| 1 | 3 | 40 | 570 | 540 | 15 | Comparative Example |
| 2 | 3 | 40 | 570 | 540 | 15 | Example |
| 3 | 3 | 40 | 570 | 540 | 15 | Example |
| 4 | 3 | 40 | 570 | 540 | 15 | Example |
| 5 | 3 | 40 | 570 | 540 | 15 | Example |
| 6 | 3 | 40 | 570 | 540 | 15 | Example |
| 7 | 3 | 40 | 570 | 540 | 15 | Example |
| 8 | 3 | 40 | 570 | 540 | 15 | Example |
| 9 | 3 | 40 | 570 | 540 | 15 | Example |
| 10 | 3 | 40 | 570 | 540 | 15 | Example |
| 11 | 3 | 40 | 570 | 540 | 15 | Example |
| 12 | 3 | 40 | 570 | 540 | 15 | Example |
| 13 | 3 | 40 | 570 | 540 | 15 | Comparative Example |
| 14 | 3 | 40 | 570 | 540 | 15 | Comparative Example |
| 15 | 3 | 40 | 570 | 540 | 15 | Comparative Example |
| 16 | 3 | 40 | 570 | 540 | 15 | Comparative Example |
| 17 | 3 | 40 | 570 | 540 | 15 | Comparative Example |
| 18 | 3 | 40 | 570 | 540 | 15 | Comparative Example |
| 19 | 3 | 40 | 570 | 540 | 15 | Comparative Example |

*1T (° C.) = −6770/(logNb + log(C + (12/14)N) − 2.26) − 273, where each of Nb, C, and N in the equation denotes the content (mass %) of the corresponding element.
*2Time between the end of finish rolling and the start of cooling.
*3Average cooling rate in a central portion in the thickness direction.
*4Cooling rate after coiling has been performed (in terms of average temperature of the edge portion in the width direction of the coil taken from the inner periphery to the outer periphery of the coil).
Underlined portions indicate items out of the range of the present invention.

By taking a JIS No. 5 tensile test piece from the hot-rolled steel sheet obtained as described above so that the tensile direction was L-direction, and by performing a tensile test, yield strength (YS), tensile strength (TS), and yield ratio (YR) were determined. In addition, after having applied a tensile strain of 5% in the L-direction to the JIS No. 5 tensile test piece for simulation of tube-making strain, a prestrain-heat treatment, in which the steel sheet is subjected to a heat treatment at a temperature of 650° C. for 60 seconds for simulation of stress-relief annealing for the purpose of removing the tube-making strain, was performed. Subsequently, by performing a tensile test again, yield strength (YS) and tensile strength (TS) after a prestrain-heat treatment had been performed and the difference (ΔYS) in yield strength between before and after the prestrain-heat treatment were determined.

In addition, by taking a test piece for observation from a position located at ½ of the thickness, and by using the method described above, microstructures were identified and the area fraction of each of the phases was determined. In addition, by taking a test piece for electrolytic extraction from a position located at ½ of the thickness, and by using the electrolytic extraction method described above, the amount of solid solution Nb was determined.

The obtained results are given in Table 3.

TABLE 3

| | | Microstructure | | | | |
|---|---|---|---|---|---|---|
| Steel Sheet No. | Steel Code | Total Area Fraction of Bainite and Bainitic Ferrite (%) | Proportion of Solid Solution Nb*1 (%) | Kind of Remainder*2 | Area Fraction of Remainder (%) | Property of Hot-rolled Steel Sheet YS (MPa) |
| 1 | A | 67 | 16 | PF, P | 33 | 362 |
| 2 | B | 89 | 22 | M | 11 | 541 |
| 3 | C | 86 | 22 | P, M | 14 | 517 |
| 4 | D | 85 | 24 | P, M | 15 | 513 |
| 5 | E | 87 | 24 | M | 13 | 532 |
| 6 | F | 85 | 30 | P, M | 15 | 508 |
| 7 | G | 87 | 31 | M | 13 | 527 |
| 8 | H | 85 | 20 | P, M | 15 | 508 |
| 9 | I | 87 | 31 | M | 13 | 532 |
| 10 | J | 87 | 24 | M | 13 | 557 |
| 11 | K | 93 | 24 | M | 7 | 619 |
| 12 | L | 97 | 24 | M | 3 | 673 |
| 13 | M | 89 | 3 | M | 11 | 541 |
| 14 | N | 81 | 15 | P, M | 19 | 480 |
| 15 | O | 71 | 30 | PF, P | 29 | 396 |

TABLE 3-continued

| | | | | | | |
|---|---|---|---|---|---|---|
| 16 | P | 71 | 29 | PF, P | 29 | 400 |
| 17 | Q | 73 | 28 | PF, P | 27 | 412 |
| 18 | R | 80 | 29 | PF, P | 20 | 471 |
| 19 | S | 82 | 39 | PF, P | 18 | 485 |

| Steel | Property of Hot-rolled Steel Sheet | | Property after Prestrain-heat Treatment | | | |
|---|---|---|---|---|---|---|
| Sheet No. | TS (MPa) | YR (%) | YS (MPa) | TS (MPa) | AYS (MPa) | Note |
| 1 | 494 | 73 | 432 | 532 | 70 | Comparative Example |
| 2 | 668 | 81 | 675 | 758 | 134 | Example |
| 3 | 646 | 80 | 651 | 740 | 134 | Example |
| 4 | 642 | 80 | 664 | 755 | 151 | Example |
| 5 | 659 | 81 | 683 | 770 | 151 | Example |
| 6 | 637 | 80 | 673 | 768 | 165 | Example |
| 7 | 655 | 80 | 647 | 727 | 120 | Example |
| 8 | 637 | 80 | 637 | 727 | 129 | Example |
| 9 | 659 | 81 | 652 | 731 | 120 | Example |
| 10 | 690 | 81 | 708 | 798 | 151 | Example |
| 11 | 750 | 83 | 772 | 866 | 153 | Example |
| 12 | 800 | 84 | 828 | 926 | 155 | Example |
| 13 | 668 | 81 | 571 | 675 | 30 | Comparative Example |
| 14 | 611 | 79 | 537 | 621 | 57 | Comparative Example |
| 15 | 529 | 75 | 507 | 612 | 111 | Comparative Example |
| 16 | 525 | 76 | 505 | 604 | 105 | Comparative Example |
| 17 | 545 | 76 | 522 | 609 | 110 | Comparative Example |
| 18 | 603 | 78 | 576 | 623 | 105 | Comparative Example |
| 19 | 616 | 79 | 535 | 620 | 50 | Comparative Example |

*[1]Proportion of solid solution Nb to the total Nb mass content.
*[2]PF denotes polygonal ferrite, P denotes pearlite, and M denotes martensite.
Underlined portions indicate items out of the range of the present invention.

As indicated in Table 3, it is clarified that, in the cases of Nos. 2 through 12, which are the examples meeting the requirements of aspects of the present invention regarding the chemical composition and the manufacturing method, the hot-rolled steel sheets have a yield strength of 480 MPa or more and a tensile strength of 600 MPa or more, a yield-strength difference (ΔYS) of 100 MPa or more, where the yield-strength difference is defined as a difference in yield strength between before and after the prestrain-heat treatment, in which the steel sheet is subjected to a heat treatment at a temperature of 650° C. for 60 seconds after 5% pre-straining, and a yield strength of 620 MPa or more after the prestrain-heat treatment has been performed.

In contrast, in the case of comparative example No. 1, since the C content was less than the range according to aspects of the present invention, it was not possible to achieve the predetermined total area fraction of bainite and bainitic ferrite due to an increase in the amount of polygonal ferrite formed during cooling, which resulted in the hot-rolled steel sheet not having the desired yield strength or tensile strength. In addition, since there was a decrease in the amount of solid solution Nb at the hot-rolled steel sheet stage due to a decrease in the proportion of solid solution Nb to the total Nb mass content, it was not possible to achieve the desired difference (ΔYS) in yield strength between before and after the prestrain-heat treatment, which resulted in the desired yield strength not being achieved after a prestrain-heat treatment. In the case of comparative example No. 13, since the Nb content was more than the range according to aspects of the present invention, there was an increase in the solid-solution temperature of Nb, which resulted in Nb remaining undissolved when the steel slab was heated. Therefore, since there was a decrease in the proportion of solid solution Nb to the total Nb mass content, it was not possible to achieve the desired yield strength after the prestrain-heat treatment had been performed or the desired difference (ΔYS) in yield strength between before and after the prestrain-heat treatment. In the case of comparative example No. 14, since the C content was more than the range according to aspects of the present invention, there was an increase in the solid-solution temperature of Nb, which resulted in a tendency for Nb to remain undissolved when the steel slab was heated. Therefore, since there was a decrease in the proportion of solid solution Nb to the total Nb mass content, it was not possible to achieve the desired yield strength after the prestrain-heat treatment had been performed or the desired difference (ΔYS) in yield strength between before and after the prestrain-heat treatment. In the case of comparative example No. 15 where the Mn content was less than the range according to aspects of the present invention, in the case of comparative example No. 16 where the Cr content was less than the range according to aspects of the present invention, and in the case of comparative example No. 17 where the Mo content was less than the range according to aspects of the present invention, since there was an increase in the amount of polygonal ferrite formed during cooling, it was not possible to achieve the predetermined total amount of bainite and bainitic ferrite in the microstructure, which resulted in the hot-rolled steel sheet not having the desired yield strength or tensile strength. As a result, it was not possible to achieve the desired yield strength after the prestrain-heat treatment had been performed. In the case of comparative example No. 18, since the Ti content was less than the range according to aspects of the present invention, there was an insufficient increase in strength through precipitation strengthening, which resulted in the hot-rolled steel sheet not having the desired yield strength. As a result, it was not possible to achieve the desired yield strength after the prestrain-heat treatment had been performed. In the case of comparative example No. 19, since the Nb content was less than the range according to aspects of the present invention, although the proportion of solid solution Nb to the total Nb mass content was high, the content of solid solution Nb was low, which resulted in the desired difference (ΔYS) in yield strength between before and after the prestrain-heat treatment not being achieved. As a result, it was not possible to achieve the desired yield strength after the prestrain-heat treatment had been performed.

Example 2

By preparing molten steels having the chemical compositions of steel codes C, F, and I given in Table 1 by using a converter, by casting the molten steels into steel slabs (steel) by using a continuous casting method, by performing a heating process, a rolling process, an accelerated cooling process, and a coiling process in this order on the steel slabs under the conditions given in Table 4, hot-rolled steel sheets having a thickness of 2.5 mm to 8.0 mm were manufactured.

As in the case of Example 1, by taking a JIS No. 5 tensile test piece from the hot-rolled steel sheet obtained as described above so that the tensile direction was the L-direction, and by performing a tensile test, yield strength (YS), tensile strength (TS), and yield ratio (YR) were determined. In addition, after having applied a tensile strain of 5% in the L-direction to the JIS No. 5 tensile test piece for simulation of tube-making strain, a prestrain-heat treatment, in which the steel sheet is subjected to a heat treatment at a temperature of 650° C. for 60 seconds for simulation of stress-relief annealing for the purpose of removing the tube-making strain, was performed. Subsequently, by performing a tensile test again, yield strength (YS) and tensile strength (TS) after a prestrain-heat treatment had been performed and a difference (ΔYS) in yield strength between before and after the prestrain-heat treatment were determined. In addition, as in the case of Example 1, microstructures were identified, and

TABLE 4

| Steel | | | Heating Process | | Rolling Process | |
|---|---|---|---|---|---|---|
| Sheet No. | Steel Code | Solid-Solution Temperature of Nb*1 T (° C.) | Temperature (° C.) | Slab Thickness (mm) | Finish Rolling Temperature (° C.) | Thickness (mm) |
| 20 | C | 1147 | 1230 | 220 | 850 | 4.5 |
| 21 | C | 1147 | 1230 | 220 | 830 | 4.5 |
| 22 | C | 1147 | 1080 | 220 | 850 | 4.5 |
| 23 | C | 1147 | 1230 | 220 | 880 | 3.0 |
| 24 | C | 1147 | 1230 | 220 | 850 | 8.0 |
| 25 | C | 1147 | 1230 | 220 | 850 | 8.0 |
| 26 | C | 1147 | 1230 | 220 | 850 | 8.0 |
| 27 | F | 1169 | 1230 | 220 | 850 | 4.5 |
| 28 | F | 1169 | 1230 | 220 | 800 | 4.5 |
| 29 | F | 1169 | 1250 | 220 | 870 | 2.5 |
| 30 | F | 1169 | 1250 | 220 | 840 | 4.5 |
| 31 | F | 1169 | 1250 | 220 | 820 | 4.5 |
| 32 | I | 1128 | 1230 | 220 | 850 | 4.5 |
| 33 | I | 1128 | 1230 | 220 | 850 | 4.5 |
| 34 | I | 1128 | 1230 | 220 | 850 | 4.5 |
| 35 | I | 1128 | 1230 | 220 | 850 | 4.5 |
| 36 | I | 1128 | 1230 | 220 | 850 | 2.5 |

| Steel | Accelerated Cooling Process | | | Coiling Process | | |
|---|---|---|---|---|---|---|
| Sheet No. | Cooling Start Time*2 (s) | Cooling Rate*3 (° C./s) | Cooling Stop Temperature (° C.) | Coiling Temperature (° C.) | Cooling Rate*4 (° C./h) | Note |
| 20 | 3 | 40 | 570 | 540 | 15 | Example |
| 21 | 3 | 80 | 530 | 500 | 15 | Example |
| 22 | 3 | 40 | 570 | 540 | 15 | Comparative Example |
| 23 | 3 | 80 | 500 | 450 | 15 | Example |
| 24 | 3 | 40 | 600 | 570 | 15 | Example |
| 25 | 3 | 10 | 570 | 540 | 15 | Comparative Example |
| 26 | 3 | 40 | 650 | 600 | 15 | Comparative Example |
| 27 | 3 | 40 | 570 | 540 | 15 | Example |
| 28 | 3 | 40 | 570 | 540 | 15 | Comparative Example |
| 29 | 3 | 80 | 570 | 540 | 15 | Example |
| 30 | 3 | 40 | 570 | 540 | 15 | Example |
| 31 | 3 | 70 | 570 | 540 | 15 | Example |
| 32 | 3 | 40 | 570 | 540 | 15 | Example |
| 33 | 3 | 40 | 650 | 630 | 15 | Comparative Example |
| 34 | 3 | 40 | 570 | 540 | 30 | Example |
| 35 | 3 | 40 | 570 | 540 | 5 | Example |
| 36 | 3 | 100 | 450 | 400 | 15 | Comparative Example |

*1 T (° C.) = −6770/(logNb + log(C + (12/14)N) − 2.26) − 273, where each of Nb, C, and N in the equation denotes the content (mass %) of the corresponding element.

*2 Time between the end of finish rolling and the start of cooling.

*3 Average cooling rate in a central portion in the thickness direction.

*4 Cooling rate after coiling has been performed (in terms of average temperature of the edge portion in the width direction of the coil taken from the inner periphery to the outer periphery of the coil).

Underlined portions indicate items out of the range of the present invention.

the area fraction of each of the phases and the amount of solid solution Nb were determined.

The obtained results are given in Table 5.

TABLE 5

| Steel Sheet No. | Steel Code | Microstructure: Total Area Fraction of Bainite and Bainitic Ferrite (%) | Proportion of Solid Solution Nb*1 (%) | Kind of Remainder*2 | Area Fraction of Remainder (%) |
|---|---|---|---|---|---|
| 20 | C | 86 | 22 | P, M | 14 |
| 21 | C | 83 | 30 | P, M | 17 |
| 22 | C | 86 | 3 | P, M | 14 |
| 23 | C | 85 | 32 | P, M | 15 |
| 24 | C | 83 | 21 | P, M | 17 |
| 25 | C | 75 | 17 | PF, P | 25 |
| 26 | C | 73 | 15 | PF, P | 27 |
| 27 | F | 85 | 30 | P, M | 15 |
| 28 | F | 77 | 25 | PF, P | 23 |
| 29 | F | 83 | 32 | P, M | 17 |
| 30 | F | 85 | 30 | P, M | 15 |
| 31 | F | 84 | 28 | P, M | 16 |
| 32 | I | 87 | 31 | M | 13 |
| 33 | I | 75 | 19 | PF, P | 25 |
| 34 | I | 85 | 33 | M | 15 |
| 35 | I | 86 | 29 | M | 14 |
| 36 | I | 10 | 36 | M | 90 |

| Steel Sheet No. | Property of Hot-rolled Steel Sheet: YS (MPa) | TS (MPa) | YR (%) | Property after Prestrain-heat Treatment: YS (MPa) | TS (MPa) | AYS (MPa) | Note |
|---|---|---|---|---|---|---|---|
| 20 | 517 | 646 | 80 | 651 | 740 | 134 | Example |
| 21 | 500 | 630 | 79 | 715 | 850 | 215 | Example |
| 22 | 520 | 650 | 80 | 550 | 680 | 30 | Comparative Example |
| 23 | 510 | 625 | 82 | 740 | 880 | 230 | Example |
| 24 | 493 | 624 | 79 | 623 | 698 | 130 | Example |
| 25 | 428 | 560 | 76 | 506 | 600 | 78 | Comparative Example |
| 26 | 419 | 555 | 75 | 489 | 589 | 70 | Comparative Example |
| 27 | 508 | 637 | 80 | 673 | 768 | 165 | Example |
| 28 | 444 | 588 | 76 | 607 | 700 | 163 | Comparative Example |
| 29 | 493 | 624 | 79 | 729 | 838 | 236 | Example |
| 30 | 508 | 637 | 80 | 673 | 768 | 165 | Example |
| 31 | 502 | 632 | 79 | 703 | 796 | 201 | Example |
| 32 | 532 | 659 | 81 | 652 | 731 | 120 | Example |
| 33 | 428 | 560 | 76 | 488 | 575 | 60 | Comparative Example |
| 34 | 510 | 639 | 80 | 641 | 721 | 131 | Example |
| 35 | 519 | 647 | 80 | 622 | 699 | 103 | Example |
| 36 | 1020 | 1150 | 89 | — | — | — | Comparative Example |

*1Proportion of solid solution Nb to the total Nb mass content.

*2PF denotes polygonal ferrite, P denotes pearlite, and M denotes martensite.

Underlined portions indicate items out of the range of the present invention.

As indicated in Table 5, it is clarified that, in the case of Nos. 20, 21, 23, 24, 27, 29 through 32, 34, and 35, which are the examples satisfying the manufacturing conditions according to aspects of the present invention and meeting the requirements of aspects of the present invention regarding the chemical composition and the manufacturing method, the hot-rolled steel sheets have a yield strength of 480 MPa or more and a tensile strength of 600 MPa or more, the yield-strength difference (ΔYS) of 100 MPa or more, where the yield-strength difference is defined as a difference in yield strength between before and after the prestrain-heat treatment, in which the steel sheet is subjected to a heat treatment at a temperature of 650° C. for 60 seconds after 5% pre-straining, and a yield strength of 620 MPa or more after the prestrain-heat treatment has been performed.

In contrast, in the case of comparative example No. 22, since the heating temperature of the steel slab was lower than the range according to aspects of the present invention, Nb remained undissolved when the steel slab was heated, which resulted in a decrease in the proportion of solid solution Nb to the total Nb mass content. As a result, it was not possible to achieve the desired yield strength after the prestrain-heat treatment had been performed or the desired difference (ΔYS) in yield strength between before and after the prestrain-heat treatment. In the case of comparative example No. 25 where the cooling rate in accelerated cooling was lower than the range according to aspects of the present invention, and in the case of comparative example No. 26 where the cooling stop temperature was higher than the range according to aspects of the present invention, since there was an increase in the amount of polygonal ferrite formed during cooling, it was not possible to achieve the predetermined total amount of bainite and bainitic ferrite in the microstructure, which resulted in the hot-rolled steel sheet not having the desired yield strength or tensile strength. In addition, since NbC was precipitated during cooling, it was not possible to achieve the desired difference (ΔYS) in yield strength between before and after the prestrain-heat treatment due to a tendency for the amount of solid solution Nb to decrease at the hot-rolled steel sheet stage, which resulted in the desired yield strength not being achieved after the prestrain-heat treatment (tube-making-stress-relief annealing) had been performed. In the case of comparative example No. 28, since the finish rolling temperature was lower than the range according to aspects of the present invention, it was not possible to achieve the predetermined total amount of bainite and bainitic ferrite in the microstructure, which resulted in the hot-rolled steel sheet not having the desired yield strength or tensile strength. As a result, although it was possible to achieve the desired difference (ΔYS) in yield strength between before and after the prestrain-heat treatment, it was not possible to achieve the desired yield strength after the prestrain-heat treatment (tube-making-stress-relief annealing). In the case of comparative example No. 33, since the coiling temperature was higher than the range according to aspects of the present invention, there was an increase in the amount of polygonal ferrite formed during cooling. Therefore, it was not possible to achieve the predetermined total amount of bainite and bainitic ferrite in the microstructure, which resulted in the hot-rolled steel sheet not having the desired yield strength or tensile strength. In addition, since there was a decrease in the amount of solid solution Nb at the hot-rolled steel sheet stage due to an excessive formation of NbC during coiling, it was not possible to achieve the desired difference (ΔYS) in yield strength between before and after the prestrain-heat treatment, which resulted in the desired yield strength not being achieved after the prestrain-heat treatment (tube-making-stress-relief annealing) had been performed. In the case of comparative example No. 36, since the coiling temperature was lower than the range according to aspects of the present invention, there is a significant increase in the strength of the hot-rolled steel sheet due to a microstructure mainly including martensite being formed, which resulted in a risk of a decrease in uniform elongation. Therefore, since a strain exceeding the uniform elongation may be applied when the hot-rolled steel sheet is subjected to a prestrain of 5% for simulation of tube making, such a hot-rolled steel sheet is considered difficult to use for coiled tubing.

INDUSTRIAL APPLICABILITY

By using the hot-rolled steel sheet according to aspects of the present invention for coiled tubing, it is possible to stably obtain coiled tubing having a yield strength of 90 ksi (620 MPa) or more, which makes a great contribution to preventing fracturing in a well.

The invention claimed is:

1. A hot-rolled steel sheet for coiled tubing, the steel sheet having a chemical composition containing, by mass %, C: 0.10% or more and 0.16% or less, Si: 0.1% or more and 0.5% or less, Mn: 0.8% or more and 1.8% or less, P: 0.001% or more and 0.020% or less, S: 0.0050% or less, Al: 0.01% or more and 0.08% or less, Cu: 0.1% or more and 0.5% or less, Ni: 0.1% or more and 0.5% or less, Cr: 0.5% or more and 0.8% or less, Mo: 0.10% or more and 0.5% or less, Nb: 0.01% or more and 0.05% or less, Ti: 0.01% or more and 0.03% or less, N: 0.001% or more and 0.006% or less, and a balance of Fe and inevitable impurities, a microstructure at a position located at ½ of a thickness of the steel sheet including bainite and bainitic ferrite in a total amount of 80% or more in terms of area fraction, in which an amount of solid solution Nb is 20% or more of a total Nb mass content, a yield strength of 480 MPa or more, a tensile strength of 600 MPa or more and 800 MPa or less, a yield-strength difference (ΔYS) of 100 MPa or more, where the yield-strength difference is defined as a difference in yield strength between before and after a prestrain-heat treatment, in which the steel sheet is subjected to a heat treatment at a temperature of 650° C. for 60 seconds after 5% pre-straining, and a yield strength of 620 MPa or more after the prestrain-heat treatment.

2. The hot-rolled steel sheet for coiled tubing according to claim 1, wherein the chemical composition further contains, by mass %, one or more selected from B: 0.0005% or more and 0.0050% or less, V: 0.01% or more and 0.10% or less, Ca: 0.0005% or more and 0.0100% or less, REM: 0.0005% or more and 0.0200% or less, Zr: 0.0005% or more and 0.0300% or less, and Mg: 0.0005% or more and 0.0100% or less.

3. A method for manufacturing the hot-rolled steel sheet for coiled tubing according to claim 2, the method comprising heating a steel slab having the chemical composition to a temperature of 1100° C. or higher and 1250° C. or lower, performing rough rolling on the heated steel slab, performing finish rolling on the rough-rolled steel slab under a condition of a finish rolling temperature of 820° C. or higher and 920° C. or lower, cooling the finish-rolled steel sheet to a temperature of 600° C. or lower at an average cooling rate of 30° C./s or higher and 100° C./s or lower in terms of a temperature in a central portion in a thickness direction of the steel sheet, and coiling the cooled steel sheet at a temperature of 450° C. or higher and 600° C. or lower.

4. A method for manufacturing the hot-rolled steel sheet for coiled tubing according to claim 1, the method comprising heating a steel slab having the chemical composition to a temperature of 1100° C. or higher and 1250° C. or lower, performing rough rolling on the heated steel slab, performing finish rolling on the rough-rolled steel slab under a condition of a finish rolling temperature of 820° C. or higher and 920° C. or lower, cooling the finish-rolled steel sheet to a temperature of 600° C. or lower at an average cooling rate of 30° C./s or higher and 100° C./s or lower in terms of a temperature in a central portion in a thickness direction of the steel sheet, and coiling the cooled steel sheet at a temperature of 450° C. or higher and 600° C. or lower.

* * * * *